US008215138B2

(12) United States Patent
Ronchi

(10) Patent No.: US 8,215,138 B2
(45) Date of Patent: Jul. 10, 2012

(54) DEVICE AND CONTINUOUS DYEING PROCESS WITH INDIGO

(75) Inventor: Francesco Ronchi, Sovico (IT)

(73) Assignee: Master S.r.l., Macherio (Milan) (IT)

( * ) Notice: Subject to any disclaimer, the term of this patent is extended or adjusted under 35 U.S.C. 154(b) by 530 days.

(21) Appl. No.: 12/312,326

(22) PCT Filed: Nov. 7, 2007

(86) PCT No.: PCT/IB2007/003454

§ 371 (c)(1),
(2), (4) Date: May 5, 2009

(87) PCT Pub. No.: WO2008/056256

PCT Pub. Date: May 15, 2008

(65) Prior Publication Data

US 2009/0265867 A1 Oct. 29, 2009

(30) Foreign Application Priority Data

Nov. 9, 2006 (IT) ..... MI06A2146

(51) Int. Cl.
*D06B 1/00* (2006.01)
*D06F 35/00* (2006.01)

(52) U.S. Cl. ..... 68/200; 8/151.2; 8/476; 8/477

(58) Field of Classification Search ..... 68/200
See application file for complete search history.

(56) References Cited

U.S. PATENT DOCUMENTS 1,941,087 A * 12/1933 Hejduk et al. ..... 68/5 C
2,120,801 A * 6/1938 Drobile ..... 427/324
3,410,865 A * 11/1968 Cornell, Jr. ..... 548/321.1
3,954,404 A * 5/1976 Childers et al. ..... 8/477
3,990,840 A 11/1976 Von Der
4,193,762 A * 3/1980 Namboodri ..... 8/477

(Continued)

FOREIGN PATENT DOCUMENTS

EP 01 591 578 A 11/2005

(Continued)

OTHER PUBLICATIONS

PCT Search Report Dated Apr. 7, 2008.

*Primary Examiner* — Michael Barr
*Assistant Examiner* — Jason Ko
(74) *Attorney, Agent, or Firm* — Hedman & Costigan, P.C.; James V. Costigan

(57) ABSTRACT

A device (100) is described, together with a continuous dyeing process with indigo and reduction dyes for warp yarn chains (3) and/or fabrics. The device (100) comprising at least one hermetically sealed dyeing compartment (1), and at least one hermetically sealed compartment (2) for the diffusion and fixing of the dye on the yarn (3). The compartment (2) is situated downstream of the dyeing compartment (1) and is functionally and hermetically connected to the dyeing compartment (1) by means of a tunnel (4). Means (12) are present inside the compartments (1, 2) and tunnel (4), for the entry of inert gas or deoxygenated air. One or more means (14, 14') for the direct application of the dye onto the yarn (3) are also present inside the dyeing compartment (1), whereas at least one tank (8) for humidifying the environment and at least one means (7) for heating the yarn (3) leaving the dyeing compartment (1), are present in the compartment (2).

19 Claims, 1 Drawing Sheet

U.S. PATENT DOCUMENTS 5,168,731 A 12/1992 Vidalis
5,611,822 A * 3/1997 Gurley ..... 8/625
5,922,084 A * 7/1999 Fuchs et al. ..... 8/149.1
6,355,073 B1 * 3/2002 Godau ..... 8/149.1
7,908,894 B2 * 3/2011 Ronchi ..... 68/5 D
2009/0000042 A1 * 1/2009 Ronchi ..... 8/646

FOREIGN PATENT DOCUMENTS

WO WO 2006/013458 * 2/2006
WO WO2006/013458 A 2/2006

* cited by examiner

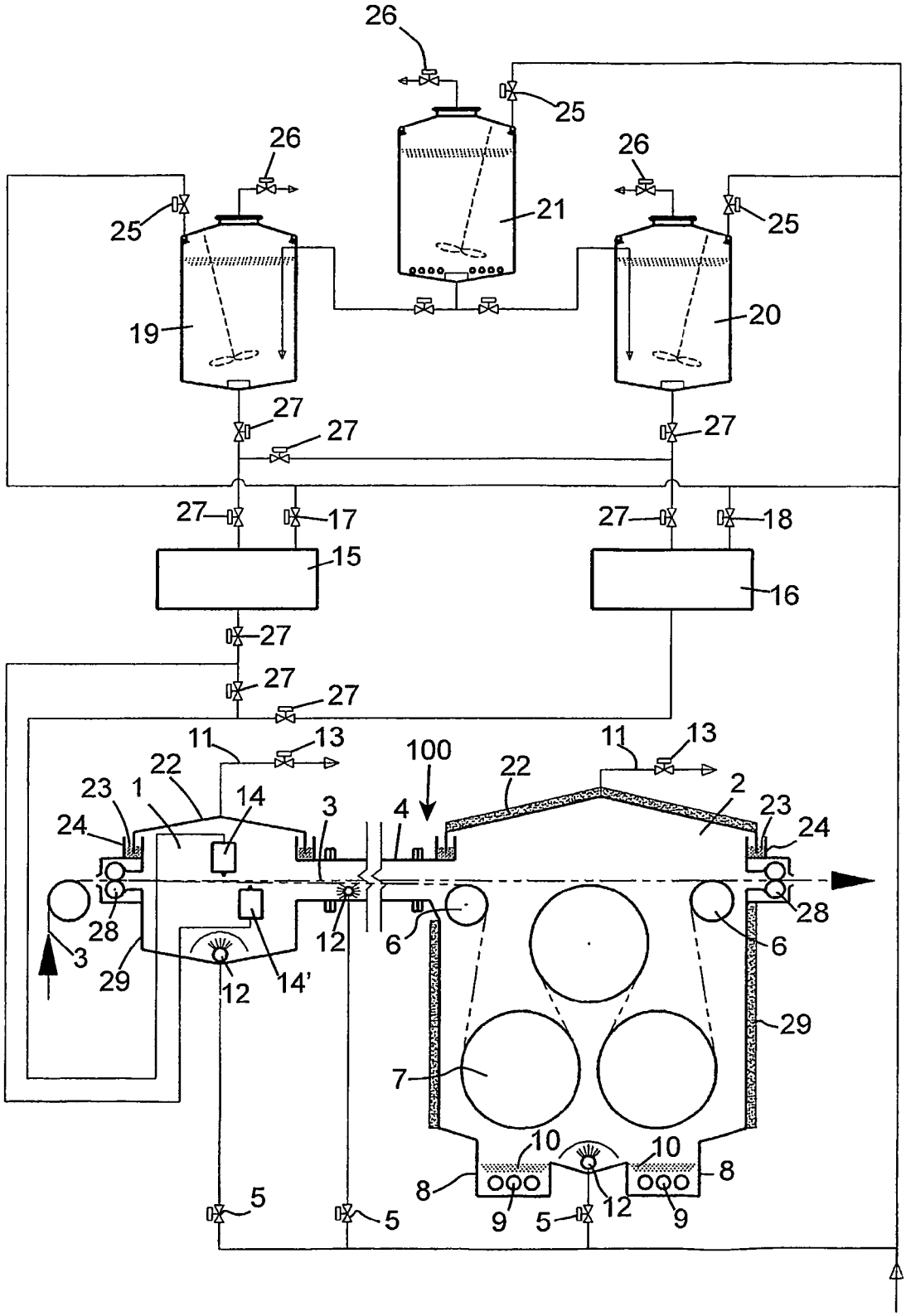
26
25
26
26
25
25
21
19
20
27
27
27
27
17
27
18
15
16
27
27
27
11
13
100
11
13
22
22
23
1
14
3
4
2
23
24
24
28
28
3
29
12
14'
12
6
6
29
7
10
10
8
8
5
5
9
5
12
9

DEVICE AND CONTINUOUS DYEING PROCESS WITH INDIGO

The present invention relates to a device and a process for continuous dyeing with indigo of warp chains for denim and/or fabrics in general.

It is known that, during its development, denim, originally used as fabric for work clothes, has become, through the production of blue-jeans, the fashion symbol for free time. On the world market for free-time clothes, in fact, denim at present undoubtedly occupies a dominant position.

Real denim, in its most classical version, is spun in continuous with a warp of cotton already dyed with indigo and a weft of white raw yarn. The success of the combination of denim-blue jeans is specifically due to the dyeing of the warp of this fabric with indigo, one of the most ancient dyes, not easy to apply to cotton for which it has a poor affinity, but which has a unique characteristic which, with time, gives the fabric, and consequently the finished item, a shiny and attractive appearance.

Blue-jeans are in fact appreciated for their typical navy-blue shade which, with repeated washing, gradually grows lighter until it becomes a shiny blue. As far as is known, no other colour apart from indigo has similar properties. Other groups of dyes, in fact, after numerous washings, become a dirty grey or mark the white yarn with an unpleasant blue/grey colour.

This particular characteristic due to the use of indigo as dye, together with the impression of a worn garment which is obtained with abrasion in the most exposed areas and which creates a plastic effect on the body of the wearer, is the basis for the fascination of blue-jeans which, produced and treated in thousands of way, are and continue to be the most widely-sold garment in the world.

One of the characteristics of indigo dye, which makes it unique, is the particular dyeing method which is required for its application to cotton yarn. This has remained more or less unvaried since the times of vegetable dyes to the present day, over a hundred years since its synthesis.

In order to be applied, in fact, this dye, with a relatively small molecule and low affinity for cellulose fibres, must not only be reduced in an alkaline solution (leuco), but also requires various impregnations with alternating squeezing and subsequent air oxidations. In practice, a medium or dark colour shade is only obtained by subjecting the yarn to a first dyeing process (impregnation, squeezing, oxidation) immediately followed by several overdyeing processes, whose number depends on the darkness of the shades and degree of colour solidity requested.

For indigo, the most widely applied dyeing technology is that in continuous, of cotton warps, on multistep plants. Each phase comprises impregnation of the yarn with the leuco solution, at a relatively low temperature, followed, after squeezing, by a passage in air to allow the leuco to oxidize, become blue and then insoluble.

The indigo applied to the fibre must be in insoluble form before the dyed yarn is impregnated again in the leuco, to prevent a part of the dye already absorbed by the yarn from being reduced, and allow it, on the contrary, to "recover" with a consequent intensification of the colour shade.

This explains the importance of the construction data of the dyeing plants, whose functioning parameters must take into account the particular properties of this dye.

The continuous dyeing with indigo, of warp chains for denim fabrics, is mainly effected according to two systems: the cord system and flat system, at rates varying from 20 to 40 meters per minute.

The flat system which is more modern and rational and also more widely-spread, is more suitable for the application of the invention which is described further on, even if application of the cord system is not excluded for possible special effects. This system, created more or less in the Seventies' of the last century, is, on the whole, a totally continuous process, as it contemporaneously effects both dyeing and sizing.

Approximately 250/400 warp threads are in fact beamed, forming a warp fraction. Approximately 10÷16 of these beams are positioned at the inlet of the dyeing machine so as to form the whole warp chain, which is passed through the dyeing tanks and then directly into the sizing machine connected therewith on line. In practice, at the beginning there are fractional beams, obtaining, after dyeing and sizing in continuous, weaving beams.

Although the two systems described above are substantially different, when dyeing with indigo however they are linked by the use of the same dyeing method essentially consisting, as already specified, of three operating phases which are repeated several times: impregnation of the yarn with the dye in reduction, squeezing to eliminate the excess wetting contained and oxidation of the dye by exposure to the air of the dyed yarn.

This particular dyeing method, which is typical of indigo dyes, demonstrates the considerable importance of respecting certain basic parameters relating to the immersion and oxidation times, to allow the dye to be impregnated and uniformly distributed in the cortical layer of the yarn (ring dyeing) and, after perfect squeezing, to be completely oxidized, before entering the subsequent tank in order to "recover", i.e. intensify the colour shade.

Unfortunately, dyeing in continuous with indigo is not only influenced by these parameters but also by numerous other factors relating to the different physico-chemical contexts of each single plant, as well as the environmental conditions where this is installed, such as temperature and relative humidity of the air, wind conditions, height, etc.

Furthermore, the different dyeing conditions, such as the number of tanks, their capacity, the pick-up (i.e. the absorption capacity of the bath), the type and rate of bath circulation, the type and accuracy of the automatic dosing systems of the indigo, sodium hydrosulfite and caustic soda, etc., and the various conditions of the dye bath, such as temperature, concentration, pH, Redox potential, etc., not only decisively influence the dyeing results such as the greater or lesser dye intensity, the solidity, the corticality, etc. but also considerably contribute to determining the final appearance of the clothes produced after the washing and enhancing treatment to which they are normally subjected.

It should also be pointed out that, contrary to other dye groups, for which the affinity for cotton increases with an increase in the temperature, for indigo the affinity and colour intensity, due to a greater corticality of the dyeing, increases with a decrease in the temperature.

More specifically, in the flat system, machines for continuous dyeing with indigo normally consist of 2÷4 pretreatment tanks, 6÷10 dyeing tanks and 2÷4 final washing tanks, all equipped with a squeezing group to eliminate the excess wetness, and the dyeing tanks also with groups of cylinders, in air, for oxidation.

The dyeing tanks are of the open type, each has a bath capacity ranging from 800 to 1,500 liters, with a content of about 4÷6 meters of yarn. These bath quantities determine the total bath volume in circulation which can consequently vary from 8,000 to 15,000 liters, respectively. The bath contained in each tank is continuously recycled to guarantee the concentration homogeneity in each tank. This circulation is normally effected by means of various known piping systems with centrifugal pumps having a high flow-rate and low prevalence to avoid harmful turbulences. Unfortunately, in spite of all the relative precautions, this movement of the bath causes the continuous exchange of its surface, which is in contact with the air, as the tanks are open above, thus causing oxidation with a consequent impoverishment of the reducing agents contained therein, i.e. sodium hydrosulfite and caustic soda, and this to an ever greater extent as the temperature of the bath increases.

There are however numerous oxidation phases, which are an integral part of the dyeing cycle and which in practice consist in exposure to the air of about 30÷40 meters of yarn impregnated with leuco, from one tank to another of the 6÷10 dyeing tanks, and therefore for a total of various hundreds of meters, which contribute to a much greater extent than what is indicated above to impoverishing the same elements of the dye bath with which the yarn itself is impregnated. This leads to the necessity of continuously reintegrating the dye bath with the quantities of sodium hydrosulfite and caustic soda destroyed by the above oxidations, in order to keep it constantly under optimum chemical conditions for the best dyeing yield and guaranteeing constant and repeatable results. These continuous additions imply a significant economic cost, they increase the salinity of the bath with consequent dyeing problems and also create considerable pollution of the final washing water.

Dye must naturally also be continuously and constantly added to the dye bath, under a condition of concentrated leuco, in the necessary quantity for obtaining the desired colour shade.

Numerous systems can be used for the automatic dosing in continuous of the indigo dye, sodium hydrosulfite and soda, such as dosage pumps, weighing, volumetric, mass systems, etc., all known however as they are normally also used in other textile processings.

The higher the volume, obviously the greater time it will take to bring a new bath to chemical/dyeing equilibrium necessary for constantly obtaining the same colour shade and the response time for possible corrective interventions will be equally lengthy. This obviously does not favour a high quality of the product.

Dye baths with indigo, however, and this is another particular characteristic of this dye, are never substituted, except for changing the colour shade, but, as already stated, they are continuously reused with the addition of sodium hydrosulfite, caustic soda and dye in order to keep their chemical/dyeing equilibrium constant. Every dyeing plant therefore has a certain number, corresponding to the blue variations being produced, of containers with the total capacity of all the dyeing tanks, for the storage and reuse of these baths.

For qualitative purposes, it is of the utmost importance to keep the physico-chemical conditions of the dyeing bath constant for the whole time necessary for the dyeing of the whole batch, said time normally oscillating between 15 and 36 hours depending on the length of the yarn and dyeing rate.

Unfortunately, in spite of the continuous mechanical and hydraulic perfectioning of dyeing machines and the help of sophisticated control and dosing systems, as a result of the large volumes in question, and also for the numerous reasons specified above, which, either individually or associated with each other, can contribute to creating undesired variations in the dye bath conditions, continuous dyeing with indigo remains a difficult operation, where very often the solving or non-solving of a problem or obtaining a good quality are also linked to the skill and experience of the operator.

This is also complicated by the fact, which is extremely important in the flat dyeing system, of the drawing-in yarn length of the dyeing/sizing line, which, in the most complete and multifunctional machines, can even reach about 500/600 meters. This not only makes it difficult to control the whole unit, but also creates waste and therefore a loss of money with the changing of each batch.

These problems are of even greater importance today than in the past, as denim is widely used in the fashion industry, where great flexibility is required with continuous requests for diversification of the colour shades, penetration and solidity with washing, and so forth, even in increasingly shorter batches.

In the light of what is specified above, there is the evident necessity of availing of a dyeing device with a high operating flexibility, which allows numerous dyeing processes with a drastic reduction in the consumption of hydrogen sulfite and soda, which does not have the problem of the salinity of the dye bath, which is simple to construct and use, which overcomes the problems that afflict the dyeing baths of the plants of the known art, which eliminates the necessity of bath recovery and storage tanks, which does not require time for reaching dyeing equilibrium, which reduces yarn scraps between every batch change and optimizes dyeing processes in terms of penetration and fixing of the indigo, making these processes independent of all external variables.

An objective of the present invention is therefore to provide a device to be used, in one or more models, in continuous dyeing plants with indigo which is simple to construct and use, which reduces the number of tanks normally used by the devices of the known art, which eliminates large bath recovery and storage tanks, with relative and consequent economical advantages, and also allows the length of the yarn to be reduced in the air passages for oxidation and consequently reduce scraps with each batch change.

A further objective of the present invention is to provide a dyeing device which makes it possible to operate in an inert environment, in order to reduce, with indigo dyeing, the current large consumption of hydrosulfite and caustic soda, without problems relating to the salinity of the baths, which reduces the production costs and improves the quality of the dyeing increasing its fixing degree and making the process independent of all external variables.

Another objective of the present invention is to provide a device which, in indigo dyeing, by operating in an inert environment, allows a better diffusion and fixing of the dye in the fibre and the maximum operating flexibility, i.e. the possibility of operating at both low and high temperatures, at both low and high concentrations and with different concentrations and colours.

Yet another objective of the present invention is to provide an ecologically advanced device which, in indigo dyeing, by operating in an inert environment, allows higher colouring and solidity yields to be obtained than those which can be obtained with the known devices, with a consequent saving of dye and lower pollution of the washing water.

Finally, a further objective of the present invention is to provide a device which, in dyeing with indigo and with other groups of reduction dyes, allows different colours and effects to be obtained on the two sides of the textile substrate.

These objectives according to the present invention are achieved by a dyeing device in continuous with indigo for chains of yarn as specified in claim 1.

Further characteristics of the invention are indicated in the subsequent claims.

The characteristics and advantages of the device and process for the dyeing in continuous with indigo according to the present invention will appear more evident from the following illustrative and non-limiting description, referring to the enclosed schematic drawings, in which:

FIG. 1 is a raised side view of a preferred embodiment of the dyeing device according to the present invention.

For the sake of clarity and descriptive simplicity, it should be noted that reference will be made hereunder to warp yarn chains only, even if the description is obviously also valid for fabrics. Furthermore, some of the elements of the dyeing plants such as the yarn pulling devices, heating means, external oxidizers, washing elements and opening/closing systems of the hoods, are not illustrated in the following description as these elements are known in the state of the art.

With reference to FIG. 1, this schematically shows a dyeing device, indicated as a whole with the reference number 100, comprising a dyeing compartment in an inert environment 1, hermetically sealed, and at least one compartment 2, also in an inert environment, for the diffusion/fixing of the dye on a generic yarn 3, situated downstream of the dyeing compartment 1. The diffusion/fixing compartment 2 in an inert environment and hermetically sealed is functionally and hermetically connected to the dyeing compartment 1 by means of a tunnel 4.

In the compartments 1 and 2 and in the tunnel 4, there are therefore means for introducing an inert gas, for example nitrogen and/or deoxygenated air, inside the compartments 1 and 2 themselves, in order to make them inert. Each of these means for the introduction of inert gas comprises at least one inlet nozzle 12 connected, by means of one valve 5, to a source (not shown) of pressurized deoxygenated air or inert gas.

In the compartment 2, there is at least one device 6 for accompanying the yarn 3 and at least one device 7 for accompanying/heating the yarn 3 with vapour.

In the particular embodiment illustrated, the means 6 consist of two accompanying cylinders, whereas the means 7 consist of three accompanying/heating cylinders, having a larger diameter with respect to the cylinders 6, as will be specified in greater detail further on.

It should in any case be pointed out that the heating of the yarn 3 can also be effected with other known means, such as for example, direct irradiation by infrared rays, radiofrequency or other means.

On the bottom of the compartment 2, externally insulated by means of insulating walls 29 and an upper hood 22, there are two tanks 8 equipped with heating coils 9, preferably with indirect vapour, for the evaporation of the water treated 10, situated close to the bottom of the compartment 2, for humidifying the environment to prevent the evaporation of the dye applied on the yarn 3 during the heating phase of the yarn 3 itself. This humidification can naturally also be obtained with other known means, such as for example, atomizers, aerosols with nitrogen and so forth.

Advantageously according to the present invention, inside the compartment 1, one or more means 14, 14' are envisaged, in substitution of the traditional dyeing tanks, for the direct application of the dye onto the yarn 3 as it advances through the tunnel 4. More specifically, each of said means 14, 14' consists, in the embodiment example illustrated, of a foam-distributing device connected, by the interpositioning of a series of valves 27, to dye feeding containers 19 and 20, with the use of said containers 19 and 20 individually, alternating or combined with each other.

It should in any case be pointed out that, even if only the dyeing device of yarns or fabrics is described and illustrated, in an inert environment, with a reduced indigo solution or reduction dyes, by means of foam distributing devices 14 and 14', the protection scope of the present invention also comprises all other possible application systems onto the yarn 3 of reduction dye solutions, always in an inert environment, such as for example spraying, atomization, spreading, doctoring, etc. and all systems which do not require the immersion of the yarn 3 in aqueous solutions contained in traditional dyeing tanks.

Considering the low humidity percentage which can be applied to the yarn 3 by the foam produced by the foam distributing devices 14, 14', in order to obtain a certain dyeing shade, a foam having a high concentration of leuco-indigo must be applied to the yarn 3 itself. For this reason, it is indispensable not only for the foaming to be effected in an inert environment but also for the foamed yarn 3 to remain for a certain period of time to allow the dye deposited to have time to spread and become fixed to the yarn which, in the case of denim, is normally raw and therefore not particularly suitable for absorption.

In this respect, the use of the tunnel 4 alone or combined with the compartment 2 is envisaged, to vary the residence time of the foamed yarn 3 in the inert environment, in relation to the concentration of dye applied and the desired diffusion and fixing degree.

Furthermore, in order to facilitate the absorption of the dye on the part of the yarn 3 and its diffusion in its interior, the compartment 2 is suitable not only for operating in an inert environment but it is also humidified by vapour saturation generated by internal barbotage or direct vapour insufflation.

As already mentioned above, the compartment 2 is also equipped with cylinders 7 fed with warm fluid, or other equivalent known means, capable of heating the yarn 3 being treated, to facilitate the diffusion and fixing of the dye onto the yarn 3, again in a humidified inert environment, thus preventing the evaporation of what is applied to the yarn 3. The cylinders 7 are preferably made of inox steel and are coated with Teflon®.

The inert environment reduces the consumption of hydrosulfite and caustic soda used in the preparation of the leuco-indigo solution in the form of foam, at both a low and high temperature, and also makes it possible to operate with leuco-indigo foams having a high concentration.

In order to make the dyeing compartment 1, the diffusion/fixing compartment 2 and the tunnel 4 inert, in addition to the nozzles 12 for the continuous entry of inert gas, there are also means 11 for the initial expulsion of the air contained in the compartments 1 and 2 and in the tunnel 4, said means 11 respectively comprising at least one discharge valve 13. An initial supply of inert gas, such as nitrogen or deoxygenated air, for a certain period of time, with the valves 13 open, allows the air to be expelled from the compartments 1 and 2 and also from the tunnel 4 due to the overpressure created inside the device 100. The supply time necessary for creating an inert environment inside the compartments 1 and 2 and the tunnel 4 is determined by instrumental detection of their internal conditions or, alternatively, is established a priori on the evaluations and calculations of experts.

The foam distributing devices 14 and 14', situated in the dyeing compartment 1 upstream of the tunnel 4 and diffusion/fixing compartment in an inert environment 2, can be indifferently positioned above or below, or on both surfaces, of the textile substrate 3 being processed. The foam distributing devices 14, 14' are fed by the foam generators 15 and 16 produced with inert gas, for example nitrogen, said generators 15 and 16 in turn being fed by the nitrogen supply system, by means of suitable valves 17 and 18, and dye feeding containers 19 and 20.

The feeding containers of the dyes 19 and 20 are fed by a dye preparation container 21, inside which the leuco solution of the reduction dye is prepared according to the usual procedures of reduction vats.

The preparation container 21 and the feeding containers 19 and 20 are fed with inert gas, for example nitrogen or deoxygenated air, by means of the valves 25 and are equipped with valves 26 for the initial expulsion of the air. By means of the valves 27, situated downstream of each feeding container 19 and 20, it is possible to operate in continuous by alternating the use of the feeding containers 19 and 20 with the use of the foam generator 15 or foam generator 16, or both.

In addition to feeding the foam distributing devices 14 and 14' with the same reduced dye solution at the same concentration and with an identical dosage, it is also possible to feed a sole distributor 14, thus dyeing only one side of the textile substrate, or feeding them separately with solutions of reduced dyes having different colours, in order to obtain a textile substrate comparable to a "double face" effect.

Both the dyeing compartment 1, upstream of the foam distributing devices 14 and 14', and the diffusion/fixing compartment 2, downstream of the accompanying cylinders 6, comprise a sealing group 28. The sealing groups 28 allow the entry and exit of the yarn 3 from the compartments 1 and 2, preventing the entry of atmospheric air and the exit of nitrogen or deoxygenated air contained therein. Said sealing groups 28 can be produced in various known ways in addition to those illustrated in FIG. 1, consisting of two opposite rubberized cylinders with relative circumferential and axial washers.

In order to favour cleaning and maintenance interventions, the dyeing compartment 1 and diffusion/fixing compartment 2 each comprise at least one hood 22, insulated with respect to the compartment 2, liftable and reclosable with respect to both containers 29 which form the compartments 1 and 2. Furthermore, the hermetic closing of both the dyeing compartment 1 and the diffusion/fixing compartment 2 is guaranteed by suitable sealing means 23 which cooperate with the hoods 22. In particular, in the preferred embodiment shown in the FIGURE, the sealing means 23 are represented by perimetric seats 24 suitable for being engaged with each hood 22 to hydraulically form an airtight seal. Alternatively, said airtight sealing means 23 can be represented by washers (not shown) interposed between the hoods 22 and the containers 29, without being excluded from the protection scope of the present invention.

The connection tunnel 4 between compartment 1 and compartment 2 can also be produced with airtight sealing, as illustrated in FIG. 1.

The device 100 according to the present invention allows yarn to be dyed, as previously specified, with indigo and other reduction dyes with a process which has the following phases:

a) applying the dyeing foam, using the means 14, 14', on one or both surfaces of the yarn 3, in an inert environment, in the compartment 1;

b) passing the yarn 3, through the tunnel 4, from the compartment 1 to compartment 2, under inert and, if needed, humid environment conditions, to give the dye time to become diffused and fixed to the fibre;

c) heating or not heating the yarn 3, by means of the cylinders 7 in compartment 2, to increase the diffusion and fixing of the dye onto the yarn 3 itself; and d) subjecting the yarn 3, in a known way, to oxidation outside the device 100.

The above dyeing process has the specific characteristic of being carried out in a substantially inert environment. In particular, phases a), b) and c) are effected in an inert environment, i.e. without the yarn 3, impregnated with the reduced dye solution (leuco), entering into contact with the oxygen of the air, thus avoiding its oxidation.

It should also be noted that, before beginning the dyeing process with indigo, a stream of nitrogen or deoxygenated air is introduced into the compartments 1 and 2 and tunnel 4, by means of the nozzles 12, for a necessary time, to expel the air contained therein, through the means 5 and 13, creating a substantially inert environment.

The inert environment thus generated is maintained as such thanks to the hermetic sealings 28 and 23 of the device 100, both for the continuous flow through the nozzles 12 and also for the inert gas which is released when the foam collapses on the yarn.

The device 100 according to the present invention can be inserted in any traditional continuous dyeing plant with indigo and various devices 100 can also be envisaged in the same dyeing plant. In addition, the device 100 according to the invention can also comprise means (not shown) for reintroducing the yarn 3 leaving the inert fixing/dehydration compartment 2 into the dyeing compartment 1. A continuous cycle dyeing process (loop) which reduces the number of devices 100 to be arranged in series in the same plant, can thus be obtained.

It can thus be seen that the device for dyeing in continuous with indigo according to the present invention achieves the objectives specified above. In particular, the device and dyeing process according to the present invention, unlike the machines and processes so far used, allow the number of treatment tanks and consequently the costs of the plants, as well as the production scraps during the batch change, to be considerably reduced.

Advantageously, according to the present invention, the dyeing device and processes effected therewith also make it possible, in the case of dyeing with indigo and reduction dyes, to operate in an inert environment, allowing the dye to be diffused and fixed in the yarn without its oxidation and considerably reducing the consumption of hydrosulfite and caustic soda, making the dyeing process more effective, economic and ecologic.

The present invention has been described for illustrative but non-limiting purposes, according to its preferred embodiments. Variations and/or modifications, however, can obviously be applied by experts in the field, all included in the relative protection scope, as defined by the enclosed claims.

The invention claimed is:

1. A continuous dyeing device (100) with indigo and reduction dyes for warp yarn chains (3) and/or fabrics, comprising at least one hermetically sealed dyeing compartment (1), and at least one hermetically sealed compartment (2) for the diffusion and fixing of the dye on said yarn (3), said at least one hermetically sealed compartment (2) being situated downstream of said dyeing compartment (1) and being functionally and hermetically connected to said dyeing compartment (1) by means of a tunnel (4), means (i2) being present inside said compartments (1, 2) and said tunnel (4), for the entry of inert gas or deoxygenated air, characterized in that one or more means (14, 14') for the direct application of said dye onto said yarn (3) also being present inside said dyeing compartment (1) and at least one tank (8) for humidifying the environment, wherein each of the at least one tanks (8) is equipped with at least one heating coil (9) for the evaporation of water treated (10), situated close to the bottom of said at least one hermetically sealed compartment (2), for the humidification of said at least one hermetically sealed compartment (2), in order to prevent the evaporation of the dye applied on said yarn (3), and at least one means (7) for heating said yarn (3) leaving said dyeing compartment (1), are present in said at least one hermetically sealed compartment (2).

2. The device (100) according to claim 1, characterized in that each of said means (14, 14') for the direct application of said dye onto said yarn (3) consists of a foam distributing device connected, by the interposition of a series of valves (27), to one or more feeding containers (19, 20) of said dye.

3. The device (100) according to claim 2, characterized in that each of said foam distributing devices (14, 14') is fed by at least one generator (15, 16) of foam produced with inert gas, said at least one foam generator (15, 16) being fed in turn by said one or more feeding containers (19, 20) of said dye.

4. The device (100) according to claim 3, characterized in that said one or more feeding containers (19, 20) of said dye are fed by one or more dye preparation containers (21), inside which the leuco solution of the reduction dye is prepared.

5. The device (100) according to claim 4, characterized in that said one or more containers (21) and said one or more containers (19, 20) are fed with inert gas by means of one or more valves (25) and are equipped with one or more valves (26) for the expulsion of air.

6. The device (100) according to claim 2, characterized in that said foam distributing devices (14, 14') are positioned above said yarn (3) to be dyed.

7. The device (100) according to claim 2, characterized in that said foam distributing devices (14, 14') are positioned below said yarn (3) to be dyed.

8. The device (100) according to claim 2, characterized in that said foam distributing devices (14, 14') are positioned on both sides of said yarn (3) to be dyed.

9. The device (100) according to claim 1, characterized in that said means (7) for heating said yarn (3) comprise at least one cylinder fed by a hot fluid.

10. The device (100) according to claim 1, characterized in that said means (7) for heating said yarn (3) comprise at least one infrared source or radiofrequency suitable for heating said yarn (3) by direct irradiation.

11. The device (100) according to claim 1, characterized in that said means (12) for the introduction of inert gas or deoxygenated air inside said compartments (1, 2) and said tunnel (4) comprise at least one inlet nozzle connected, by means of a valve (5), to a source of pressurized deoxygenated air or inert gas.

12. The device (100) according to claim 1, characterized in that it comprises means (11) for the initial expulsion of the air contained in said compartments (1, 2) and said tunnel (4), said means (11) respectively comprise at least one discharge valve (13).

13. The device (100) according to claim 1, characterized in that said compartments (1, 2) each comprise at least one sealing group (28) which allows the entry into said compartment (1) and the exit from said compartment (2) of said yarn (3), preventing the entry of atmospheric air into said compartments (1, 2) and the exit of inert gas or deoxygenated air from said compartments (1, 2).

14. The device (100) according to claim 13, characterized in that said at least one sealing group (28) consists of two opposite rubberized cylinders with relative circumferential and axial washers.

15. The device (100) according to claim 1, characterized in that said hermetically sealed compartments (1, 2) comprise at least one container (29) and at least one liftable hood (22) with respect to said container (29) for cleaning and maintenance operations, said hood (22) being hermetically reclosable on said container (29).

16. The device (100) according to claim 15, characterized in that said hermetically sealed compartments (1, 2) comprise airtight sealing means (23).

17. A continuous dyeing process with indigo and reduction dyes for warp yarn (3) chains and/or fabrics using the device (100) according to claim 1, characterized in that it comprises the following phases: a) applying the dyeing foam, with said means (14,14'), on one or both surfaces of said yarn (3) in said compartment (1); b) passing said yarn (3), through said tunnel (4), from said compartment (1) to said compartment (2), possibly humidified, to give the dye time to become diffused and fixed onto said yarn (3); c) heating said yarn (3), by said at least one device (7) in said compartment (2), to increase the diffusion and fixing of said dye, and d) subjecting said dyed yarn (3) to oxidation outside said device (100).

18. The dyeing process according to claim 17, characterized in that phases a) to c) are carried out in an inert environment.

19. The dyeing process according to claim 17, characterized in that before beginning the dyeing process, a stream of nitrogen and/or deoxygenated air is charged into said compartments (1, 2) and into said tunnel (4) for a time sufficient for obtaining an inert environment inside said compartments (1, 2).

* * * * *